US007908968B2

(12) United States Patent
McCoin et al.

(10) Patent No.: US 7,908,968 B2
(45) Date of Patent: Mar. 22, 2011

(54) VERTICAL MARKING SYSTEM

(76) Inventors: Jerry Wayne McCoin, Portland, TN (US); Wanda Sue McCoin, Portland, TN (US)

( * ) Notice: Subject to any disclaimer, the term of this patent is extended or adjusted under 35 U.S.C. 154(b) by 427 days.

(21) Appl. No.: 12/039,811

(22) Filed: Feb. 29, 2008

(65) Prior Publication Data

US 2008/0309747 A1 Dec. 18, 2008

Related U.S. Application Data

(60) Provisional application No. 60/943,614, filed on Jun. 13, 2007.

(51) Int. Cl.
*B41F 17/26* (2006.01)
*B23K 26/00* (2006.01)
*B41J 2/435* (2006.01)

(52) U.S. Cl. ..... 101/476; 219/121.68; 347/248

(58) Field of Classification Search ..... 101/476; 219/121.68; 347/248
See application file for complete search history.

(56) References Cited

U.S. PATENT DOCUMENTS

| | | | | |
|---|---|---|---|---|
| 5,417,159 | A * | 5/1995 | Mains, Sr. | 101/476 |
| 6,326,590 | B1 * | 12/2001 | Shaffer et al. | 219/121.84 |
| 6,400,389 | B1 * | 6/2002 | Shaffer et al. | 347/241 |
| 6,791,592 | B2 * | 9/2004 | Assa et al. | 347/225 |
| 7,009,633 | B2 * | 3/2006 | Steenackers | 347/227 |
| 7,361,862 | B2 * | 4/2008 | Canella et al. | 219/121.62 |
| 2004/0159388 | A1 * | 8/2004 | Perala | 156/64 |

* cited by examiner

*Primary Examiner* — Uyen-Chau N Le
*Assistant Examiner* — John M Bedtelyon
(74) *Attorney, Agent, or Firm* — James Addison Barry, Jr.

(57) ABSTRACT

A system, apparatus, and method for a vertical marking system 100 comprising a means for marking 250 and a means for vertical positioning 200 wherein the means for marking 250 is attached with the means for vertical positioning 200. The vertical marking system 100 may include a means for moving the vertical stack of items 300 through the vertical marking system 100 whereby the vertical stack of items may transition from an entry end 320 of the vertical marking system 100 to an exit end 330 of the vertical marking system 100; a programmable control system 100 for adjusting the distance between multiple means for vertical positioning mechanisms; and a means for centering 400 the vertical stack of items in relationship to the means for marking 250.

10 Claims, 9 Drawing Sheets

VERTICAL MARKING SYSTEM

CROSS-REFERENCE

This application claims the benefit of U.S. Provisional Application Ser. No. 60/943,614, filed Jun. 13, 2007, titled Vertical Marking System. The present application is related by the same inventors for all applications; Jerry Wayne McCoin, and Wanda Sue McCoin. The U.S. Provisional Application Ser. No. 60/943,614, filed Jun. 13, 2007, titled Vertical Marking System is hereby incorporated in its entirety by reference.

FIELD OF INVENTION

The present invention relates to a device for marking a vertical stack of pallets, boxes, or items in a single cycle process.

BACKGROUND OF INVENTION

Wooden pallets may be required to be heat treated and after heat treating to be marked with a certification stamp or marking. These requirements may apply to international shipment of pallets as well as some interstate and interregional shipments. ISPM 15 standards currently require all heat treatment certification stamps be administered after the heat treating process. Current technology and regulations require that the pallets be in a vertical stack for required heat soaking. Typically, the pallets are first built, next stacked, then heat treated, and finally stamped. Regulations may require the pallets to be marked on two opposing sides of the pallet after heat treating. Heat treating chambers are designed to heat treat pallets in a vertical stack. However, the horizontal, automated printing, stamping processes that are now in place are not designed so that pallet can be marked or stamped after they are heat-treated while still in a vertical stack. With current horizontal, automated marking systems each pallet must be moved from a vertical stack to a horizontal line to be marked or stamped in a horizontal production process. This requires very costly and unproductive un-stacking of the pallets after heat-treating followed by restacking in the vertical stack for shipping. An alternative is to manually hand-stamp each pallet in a vertical stack but this is very time consuming and labor intensified. When pallets are stamped or marked manually, it takes one or two people to perform the operation and the forklift operator is still needed to move the stacks of pallets for them.

For pallet heat treating, it would be more efficient to have a system or process where the pallets are not un-stacked between the heat treating process and the marking and certifying process such that the pallets remain stacked ready for shipment. Therefore, it would be beneficial to have a vertical, automated marking system to apply markings or a heat treatment certification such that the pallets or other items could be marked vertically instead of un-stacked for the marking process.

SUMMARY

A system, apparatus, and method for a vertical marking system comprising a means for marking and a means for vertical positioning wherein the means for marking is attached with the means for vertical positioning. The vertical marking system may include a means for moving the vertical stack of items through the vertical marking system whereby the vertical stack of items may transition from an entry end of the vertical marking system to an exit end of the vertical marking system; a programmable control system for adjusting the distance between multiple means for vertical positioning mechanisms; and a means for centering the vertical stack of items in relationship to the means for marking.

BRIEF DESCRIPTION OF THE DRAWINGS

The features, aspects, and advantages of the invention will become better understood with regard to the following description, appended claims, and accompanying drawings where:

DETAILED DESCRIPTION OF THE INVENTION

Figure 1:
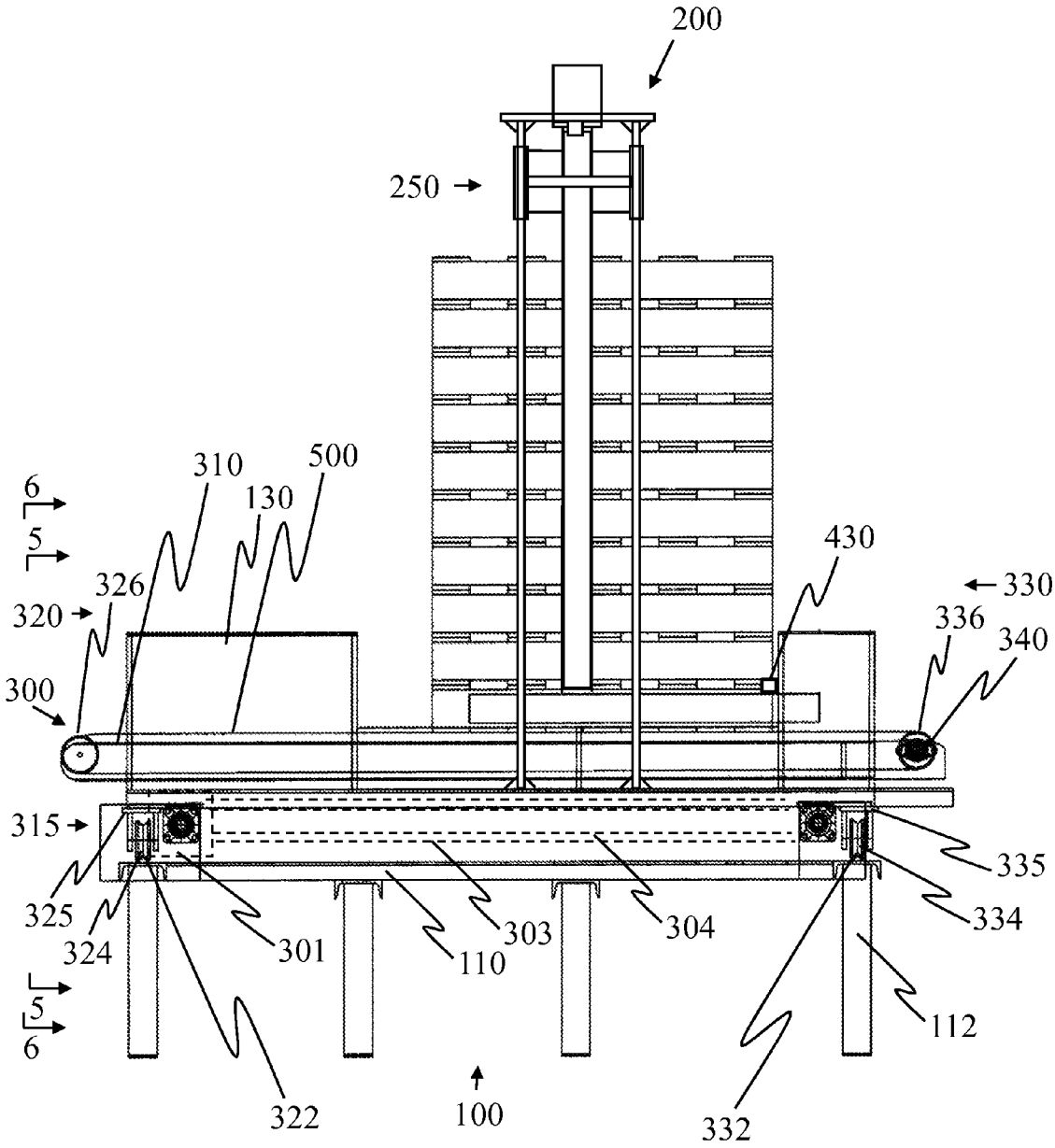
FIG. 1 is a side view of one embodiment of the vertical marking system in use.
Figure 2:
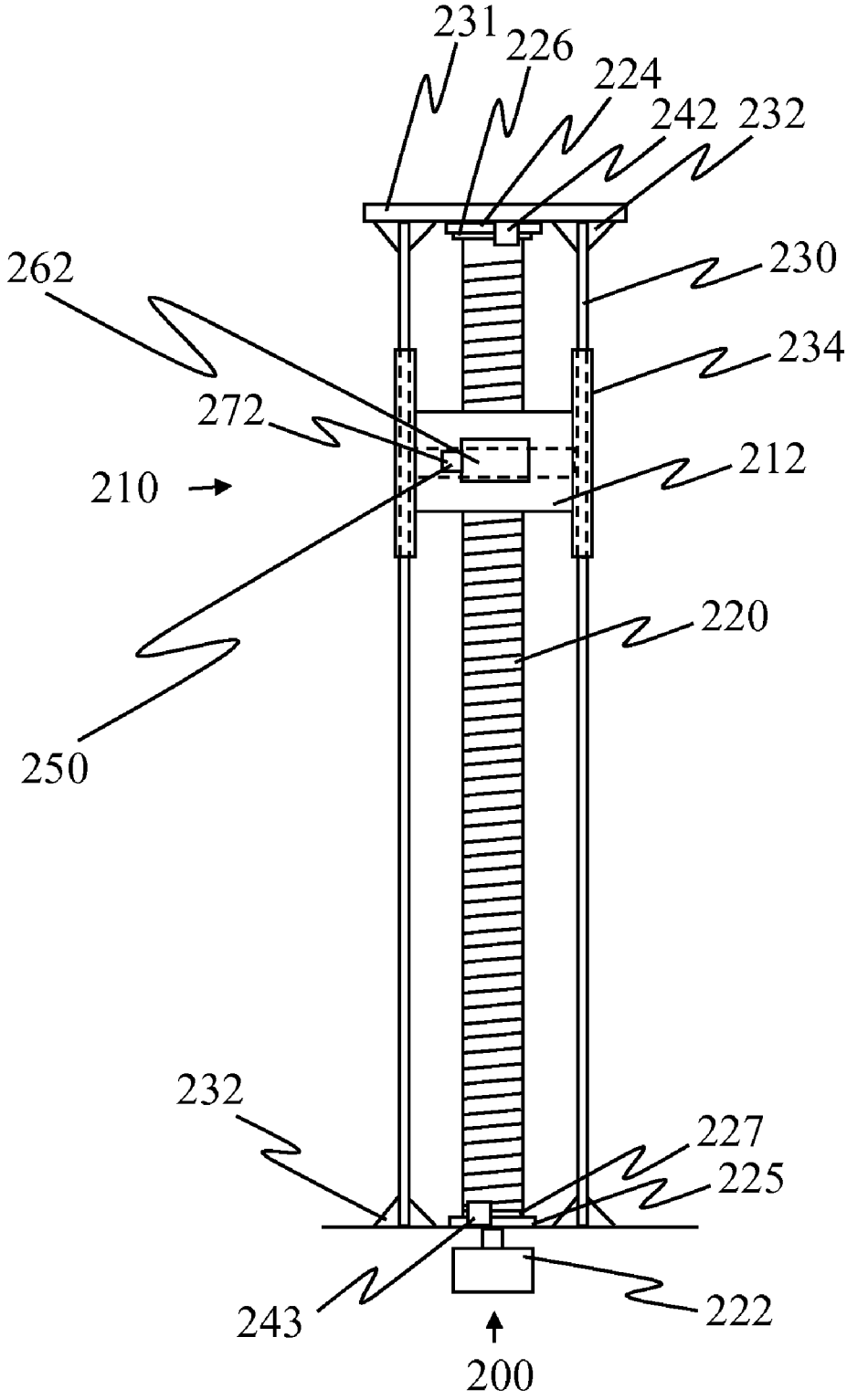
FIG. 2 is a front view of the vertical marking system depicting one embodiment of the vertical positioning mechanism with means for marking.
Figure 3:
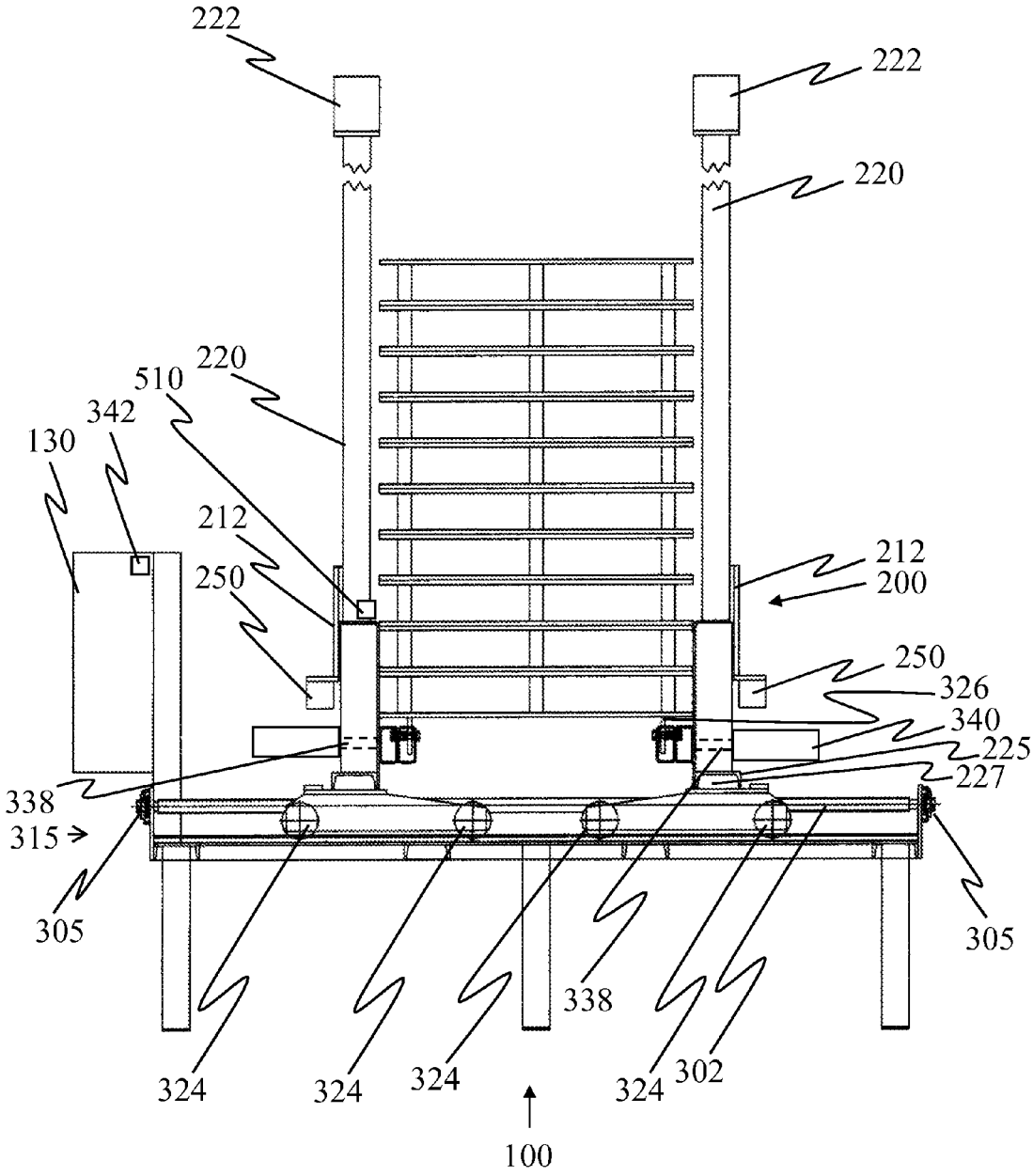
FIG. 3 is an entry front view of one embodiment of a vertical marking system.

The present invention relates to the field of marking a vertical stack of pallets or other vertically stacked items in a single cycle process. The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein.

Overview:

A vertical marking system 100 as illustrated in FIGS. 1 through 9C is a device, system, and method for vertically marking a stack of pallets or other vertically stacked items in a single cycle process. The vertical marking system 100 can stamp, imprint, mark, or print a stack of pallets or other stacked items vertically. The vertical marking system 100 is designed to print, imprint, or mark a marking or certification on a stack of pallets or other stacked items vertically as the marker moves either upward, or downward. If desired, the vertical marking system 100 may eliminate the need for the marker head to return to bottom before it starts printing again. In addition, this device allows vertical stacks of pallets to be taken directly from a heat treatment chamber and placed in the vertical marking system 100 without the need for un-stacking the pallets thus eliminating many hours of labor; and allowing for a more productive, cost efficient operation. The vertical marking system 100 can be used to mark the size of a pallet, a company name or identification number, heat-treat marks, or other identifying marks on stacks of pallets or other stacked items and place a more legible mark on the items than one that is manually placed on the item or pallet.

Design Specifications:

A Vertical Marking System 100:

The vertical marking system 100 includes a means for vertical positioning 200 and a means for marking 250. The means for vertical positioning 200 positions or aligns the means for marking 250 in relation to a vertical stack of items for marking an item or items. A programmable control system 130 may be operationally connected with the vertical marking system 100, including the means for vertical positioning 200, and the means for marking 250. The vertical stack of items, the item, or the items are defined as workpieces for the vertical marking system 100 to mark or imprint. The means for vertical positioning 200 starts moving the means for marking 250 vertically and continues moving vertically until reaching a stop signal. The stop signal is defined as an upper limit of travel or a lower limit of travel with switches and/or vertical sensors 272. Upon reaching the stop signal the vertical movement stops such that a current vertical stack of items may be replaced with a next vertical stack of items. The current vertical stack of items is defined as the vertical stack of items the means for marking 250 is currently marking and the next vertical stack of items is defined as the vertical stack of items awaiting marking. The means for marking 250 as detailed in this specification imprints markings on the items of the vertical stack of items. The means for vertical positioning 200 as detailed in this specification may continue from upper limit to lower limit or the lower limit to the upper limit marking the items in the vertical stack of items without needing to pause for marking with certain means of marking 250. With other means of marking 250, the means for vertical positioning 200 may pause between the upper limit and lower limit for marking the items in the vertical stack of items and then resume vertical movement until reaching the stop signal. The vertical marking system 100 may be constructed for a vertical stack of 20-22 wooden pallets which is an optimum size for many heat treatment chambers. The vertical marking system 100 may include a means for moving the vertical stack of items 300 through the vertical marking system 100 whereby the vertical stack of items may transition from an entry end 320 of the vertical marking system to an exit end 330 of the vertical marking system.

A Means for Vertical Positioning 200:

A vertical marking system 100 may include the vertical positioning mechanism 200; the means for marking 250; a vertical sensor 272 attached with the vertical marking system 100 for sensing the items that are in the vertical stack of items and for sensing an upper limit of travel and a lower limit of travel for the vertical positioning mechanism 200; and a programmable control system 130 for controlling the vertical marking system 100 such that the programmable control system 130 is operationally connected with the vertical positioning mechanism 200, the means for marking 250 or a laser marker 262, and the vertical sensor 272 such that the means for marking 250 continues moving vertically until reaching a marking signal, whereby the marking signal is computed by the programmable control system 130 operationally connected with the vertical sensor 272 and is aligned, and may pause the vertical movement, such that the means for marking 250 is vertically aligned in relation to the item of the vertical stack of items for marking, marks the item, and thereafter the vertical positioning mechanism 200 moves the means for marking 250 vertically and continues moving vertically and marking items until reaching a stop signal, whereby the stop signal may be computed by the programmable control system 130 operationally connected with the vertical sensor 272 and is the upper or lower limit of travel, wherein the vertical movement stops for replacing the vertical stack of items with a next vertical stack of items. The means for vertical positioning 200 may include a hydraulic lift, a chain driven lift, a scissor lift frame, a travel mechanism or the vertical positioning mechanism 200. The vertical positioning mechanism 200 may include a vertical positioning frame 210; an upper support structure 231; a vertical positioning mechanism plate 212 for attaching the means for marking 250 with the vertical positioning mechanism 200; a vertical worm screw or a vertical ball screw nut threaded rod 220, including upper and lower vertical worm screw or threaded rod bearings 226, 227 for attaching the vertical worm screw or threaded rod 220 with the vertical positioning frame 200, and the upper support structure 231; a vertical worm screw or threaded rod gear motor 222 attached with the threaded rod 220 and the vertical positioning mechanism 200; and vertical support tubing 230 attached with the vertical positioning frame 210, the vertical positioning plate 212, and the upper support structure 231 such that the vertical positioning plate 212 is attached with the threaded rod 220 and the vertical positioning plate 212 travels vertically up and down as the threaded rod 220 is rotated by the threaded rod gear motor 222 whereby the programmable control system 130 is operationally connected with the vertical threaded rod motor 222 and the vertical sensor 272 for vertically raising and lowering the laser marker 262. The travel or vertical positioning mechanism frame 210 may include a structure for the travel or vertical positioning mechanism 200 which may include: A travel mechanism plate 212 that may be threaded to fit with a vertical worm screw 220 and by turning the vertical worm screw 220 the travel mechanism plate 212 travels up and down the vertical worm screw 220. In one embodiment the vertical positioning mechanism plate or the travel mechanism plate 212 may be approximately 6 inches by 6 inches. The vertical worm screw 220 may be attached with the travel mechanism frame 210 with an upper and a lower travel mechanism worm screw bearing 226, 227 with set screws or locking collar bearing. A lower threaded rod bearing bracket 225 may be welded in center lower outside portion of each of vertical positioning mechanism 200. An upper threaded rod bearing bracket 224 may be welded with the center portion of an upper support structure 231 or upper support structure 231 attached with the top of the vertical support tubing 230 approximately 110 inches up on the vertical support tubing 230. The upper and lower threaded rod bearing 226, 227 may be bolted to upper and lower threaded rod bearing bracket 224, 225, for holding the vertical threaded rod 220. A vertical threaded rod gear motor 222 may be mounted with bottom or top of the vertical threaded rod 220 for turning the vertical threaded rod 220 for raising and lowering the vertical positioning mechanism plate 212. With the vertical positioning mechanism 200 on two opposing sides for marking two opposing side of the vertical stack of items concurrently, two vertical threaded rod gear motors 222 may be required. The vertical positioning frame 210 may include the vertical support tubing 230 located on each side of the vertical threaded rod 220 wherein the vertical threaded rod 220 may be in the center of the vertical positioning frame 210 with the vertical support tubing 230 welded eight inches outward in both directions from the center of the vertical threaded rod 220 and vertical positioning mechanism 200. The vertical support tubing 230 may be linear bearing, seamless tubing, or telescoping tubing. The upper vertical support structure 231 may be welded at top of the vertical support tubing 230 for support. The upper support structure 231 may attach the vertical support tubing 230 with the upper threaded rod bearing bracket 224. Gusset support brackets 232 may be welded to the vertical support tubing 230 and the upper support structure 231 as well as the vertical support tubing 230 and the vertical positioning mechanism 200 for additional support and strength. The vertical positioning mechanism sleeves 234 may fit over each of the vertical support tubing 230 and may be attached with the vertical positioning mechanism plate 212. The vertical positioning mechanism sleeves 234 may be 12 inch sleeves in length. Brackets may be used for attaching the different limit switches for the vertical marking system 100. An upper limit switch 242 may set a limit for the vertical positioning mechanism 200 and act as a stop signal by signaling the programmable control system 130 that the vertical marking process has been completed in the upward direction and send a signal to eject the vertical stack of items. The upper limit switch 242 may be bolted on vertical threaded rod 220, the upper support structure 231, or the vertical support tubing 230. The upper limit switch 242 may be operationally connected with the programmable control system 130. In addition, a lower limit switch 243 may be included with the vertical positioning mechanism 200 wherein the lower limit switch is 243 disposed with the bottom portion of the vertical positioning mechanism 200 that may stop the vertical movement of the vertical positioning mechanism 200. The lower limit switch 243 may set a limit for bottom of vertical positioning mechanism 200 and act as stop signal by signaling the programmable control system 130 that the vertical marking process has been completed in the downward direction and send a signal to eject the vertical stack of items. The lower limit switch 243 may be bolted on vertical threaded rod 220, the vertical positioning mechanism 200, or the vertical support tubing 230. The lower limit switch 243 may act as a safety stop for the downward motion of the vertical positioning mechanism 200. The lower limit switch 243 may be operationally connected with the programmable control system 130.

A Means For Marking 250:

In one embodiment the means for marking 250 may include a print head 262 attached with the means for vertical positioning, travel mechanism, or vertical positioning mechanism 200 or vertical positioning mechanism plate 212 wherein the print head 262 may be attached with the vertical positioning mechanism plate 212 with bolts. The print head 262 may include a laser print head, an ink jet print head, a brander, or other marking device operationally connected to the programmable control system 130. If the laser marker 262 travels slower, the laser marker 262 is filled in more for easier reading of the mark. The laser marker 262 may include a defused lens 292 that produces a broader mark on the item. The defused lens 292 does not focus the laser beam as tightly thus burning a wider mark. For safety, the laser marker 262 and the brander may include a means for protection 294 from a laser injury similar to a guard around the means for marking to prevent personal injuries. The means for protection 294 may be as simple as a metal plate extending in the direction of the laser beam to prevent a hand from extending in the path of the laser beam. Due to the possibility of smoke being created by the laser marker or the brander, a means for removing smoke 296 including but not limited to a vacuum tube may be included to suction the smoke away and exhaust it from the work area. With the laser print head embodiment, a means for controlling the distance 280 between the means for marking 250 and the item being marked may not be as critical as the laser marker 262 may mark a longer distance from workpiece. With an ink jet print head embodiment, the ink jet head 262 may need to be about one fourth of an inch from the workpiece and in addition to vertical movement and movement toward and away from the vertical stack, the ink jet print head may need to move horizontally as much as five inches. Therefore, the ink jet head 262 may require the means for controlling the distance 280 between the means for marking 250 and the item being marked. The means for controlling the distance between the marking means and the item being marked may include the programmable control system 130 and a distance controlling sensor 282 or photo eye along with a mechanical driven or air driven extension device to provide movement into or away from the item to mark the item. A printer sensor 272 may be included and attached with the vertical positioning mechanism plate 212 or print head 262 for sensing the distance from the print head 262 or means for marking 250 to the workpiece to mark. In some embodiments, the printer sensor 272 and the distance controlling sensor 282 may be the same sensor fulfilling a dual function. The print head 262 and or programmable control system 130 may be programmed for multiple different markings by wire communication or wireless communication 600. This will assist in complying with requirements that stamps or markings must be legible and traceable as well as permanent on pallets for international regulation compliance. A wireless communications system 600 operationally connected with the means for marking 250 will further allow for remote changing of designs and markings for different customer or order requirements. The printer sensor 272 may further sense the middle of each item to mark. The printer sensor 272 may include photo cells or fiber optic eyes. Another means for controlling the vertical positioning 200 and the means for marking 250 vertically may include timing and or distance traveled by the vertical positioning mechanism 200 along with the programmable control system 130 to compute and control the locations to mark the items or a marking signal.

The Programmable Control System 130:

The programmable control system 130 may control a means for marking 250 including the print head 262 and the vertical marking process; and a means for vertical positioning 200 including up and down vertical positioning whereby the vertical marking process starts vertically and continues until reaching a marking signal or a stop signal; a means for centering 400 the vertically stacked items in relation to the vertical positioning mechanism 200; the position of adjustable width vertical positioning mechanisms 200; and a means for horizontally moving the vertically stacked items through the vertical marking system 100. The programmable control system 130 is operationally connected wherein the operational connection may include directly wired and/or wireless connections for input and output. The programmable control system 130 may print in one vertical direction, either up or down, then eject the vertical stack of items, next position the next stack of items, and resume print in the other vertical direction, either up or down. This is more efficient with time and there is less wear on the moving parts. The forward/reverse electrical switch 342, starter and fuse block may be attached with the programmable control system 130. An Allen and Bradley model 1762-L24BWARE MICROLOGIC 1200 is one of several processors that may be used with the programmable control system 130.

A Vertical Marking System Frame 110:

The vertical marking system 100 may include a means for moving the vertical stack of items 300 through the vertical marking system 100. The means for moving the vertical stack of items through the vertical marking system 100 may include the vertical marking system frame 110, a horizontal drive chain 500, a means for centering 400, a means for marking 250, and multiple adjustable vertical positioning mechanisms 200. The vertical positioning mechanism 200 may be attached with the vertical marking system frame 110 and the vertical marking system frame 110 may include a base 112, an entry end 320 of the base, and an exit end 330 of the base. The vertical marking system frame 110 is the lower part of the vertical marking system 100 and may be made of steel channel and tubing.

A Horizontal Drive Chain 500:

The vertical marking system 100 may include an idler sprocket 326, a drive sprocket 336, a drive chain 500, and a drive chain motor 340, wherein the idler sprocket 326 and the drive sprocket 336 may be attached with the vertical positioning mechanism 200 or the vertical marking system frame 110; the drive chain 500 is attached with the idler sprocket 326 and the drive sprocket 336; and the drive chain motor 340 is attached with the drive sprocket 336 such that the drive chain 500 moves the vertical stack of items horizontally from the entry end 320 of the vertical marking system frame 110 to the exit end 330. A horizontal activation sensor 510 may be attached with the vertical marking system 100 wherein the horizontal activation sensor 510 is operationally connected with the programmable control system 130 such that horizontal activation sensor 510 senses the vertical stack of items at the entry end 320 of the vertical marking system 100 and the programmable control system 130 activates the drive chain 500 to transition the vertical stack of items through the vertical marking system 100. The drive chain activation electrical limit switch 510 may be bolted on the top portion of the vertical positioning mechanism 200 left side referenced as facing the entry end 320 and disposed approximately two feet from the entry end 320 of the vertical marking system 100. The drive chain electrical limit switch or horizontal activation sensor 510 may be preferably a photo cell operationally connected with the programmable control system 130 that activates the horizontal drive chain 500 when a vertical stack is sensed. The drive chain track 310 includes a track made of tubing or channel mounted, that may be welded, on the inside of each vertical positioning mechanism 200, for mounting an idler sprocket 336 and a drive sprocket 336 on each drive chain track 310 for supporting a drive chain 500. The idler sprocket 326 may be bolted to the side drive chain track 310. The idler sprockets 326 may be number 60 size sprockets. The drive sprocket 336 may be bolted to the drive chain track 310. The drive sprockets 336 may be number 60 type sprockets. The vertical marking system frame 110 may include dead rollers for assisting the vertical stack in exiting the vertical marking system 100 as the vertical stack approaches the end of the drive chain 500 at the exit end 330 of the vertical marking system frame 110. The horizontal drive chain 500 may include roller chain that may be number 60 type chain cut to length. The drive chain 500 may be engaged with the idler sprocket 326 and drive sprocket 336 then connected with a master link. The electrical drive chain gear motor 340 may be attached with each vertical positioning mechanism 200 preferably bolted on the vertical positioning mechanism 200 and connected with the electrical drive chain shaft 338 for powering drive chain shaft 338 to power the horizontal drive chain 500 for moving the vertical stack horizontally through the vertical marking system 100 from the entry end 320 to the exit end 330. The electrical drive chain shaft 338 may be attached with bearings. One embodiment may include one electrical drive chain gear motor 340 with each drive chain 500 on each of the two vertical positioning mechanisms 200. In addition, a forward/reverse electrical switch 342 may be include with the electrical drive chain gear motor 340 for adjusting the vertical stack disposition as it moves through the vertical marking system 100 from the entry end 320 to the exit end 330. The forward/reverse electrical switch 342 may be operationally connected to the electrical drive chain gear motor 340 and the programmable control system 130. The vertical threaded rod gear motor 222, the adjustable width gear motor 301, and the electrical drive chain gear motor 340 may use couples for attaching with the sprockets or worm drives.

Figure 4:
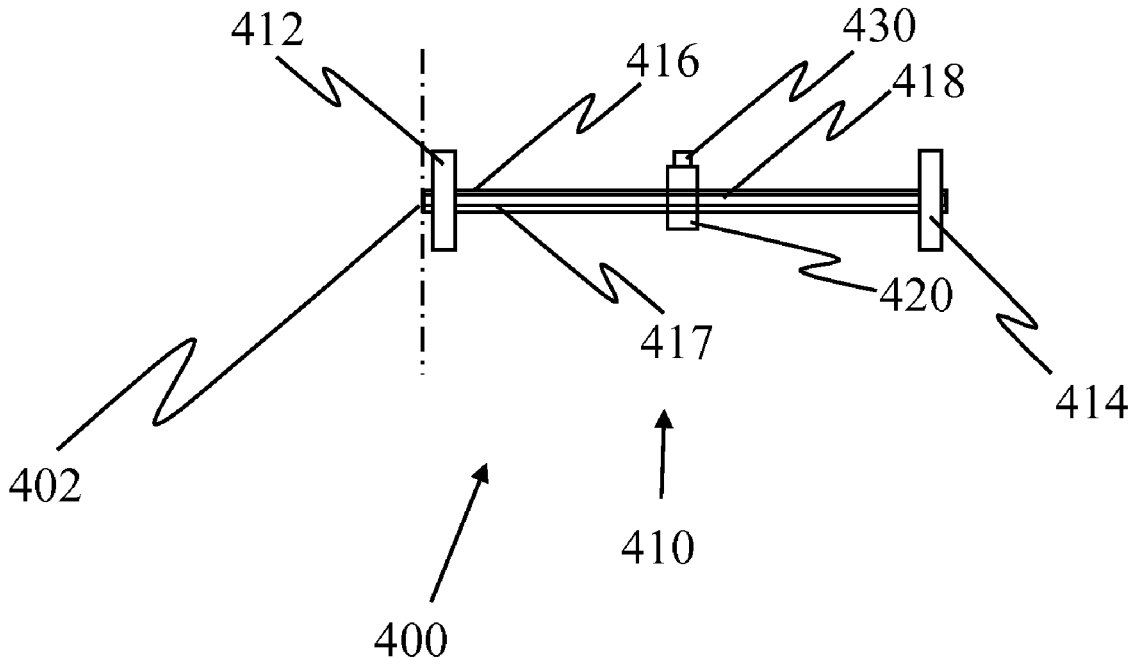
FIG. 4 is a front view of a centering bar depicting one embodiment of the vertical marking system.
Figure 5:
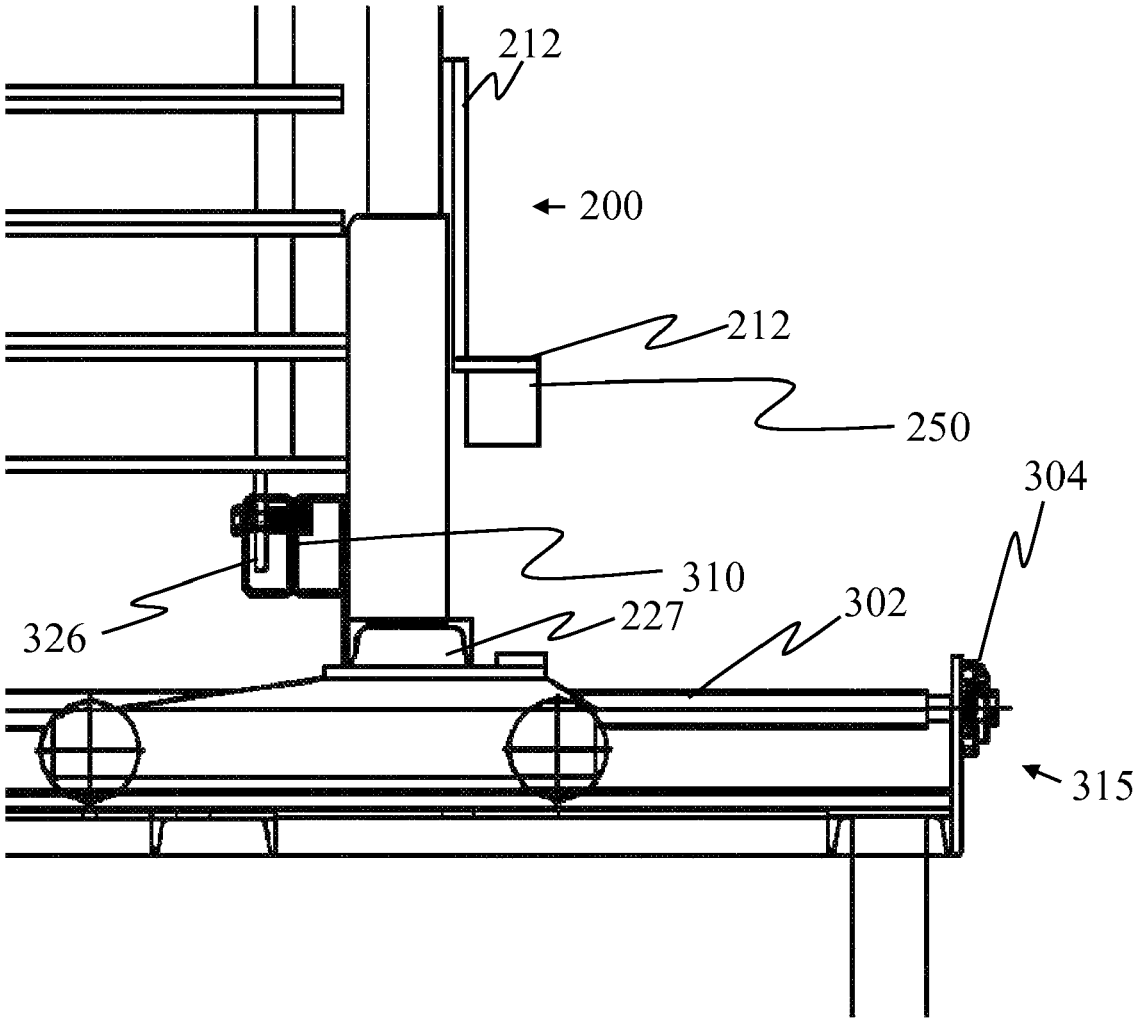
FIG. 5 is a partial entry right front view of the embodiment of FIG. 3 along the line 5-5 of a vertical marking system.
Figure 6:
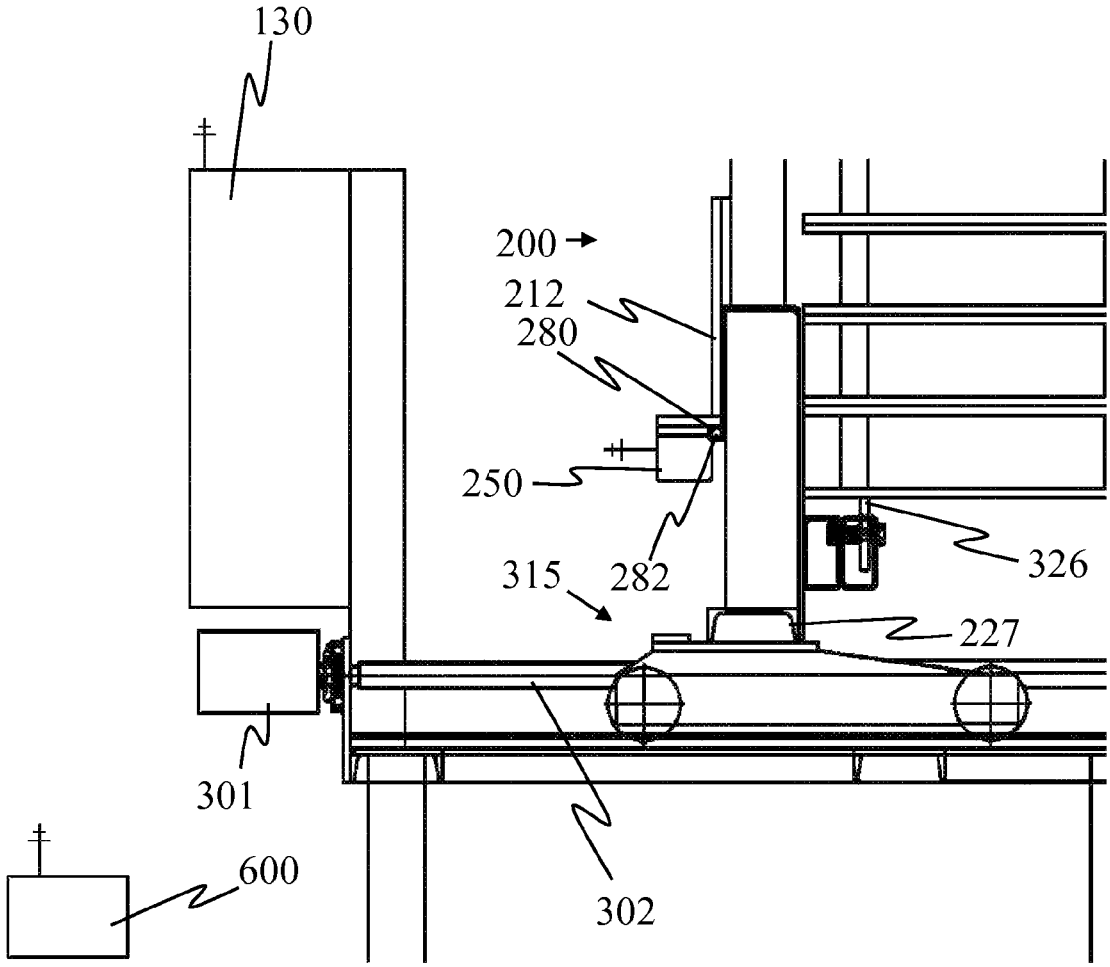
FIG. 6 is a partial entry left front view of the embodiment of FIG. 3 along the line 6-6 of a vertical marking system.

A Means for Centering 400:

The vertical marking system 100 may include a means for centering 400 the vertical stack of items for alignment with the means for marking 250. A horizontal alignment sensor 430 may be operationally connected with the programmable control system 130 whereby the horizontal alignment sensor 430 stops the drive chain when the vertical stack of items is in alignment for marking with the means for marking 250. The means for centering 400 may include the vertical stack of items being centered by: being manually positioned by forklift driver, the forklift driver may use a light that comes on when the vertical stack is adjusted to mid location by forklift driver, an automatic system with a drive chain 500 may adjusts the position of vertical stack to center after manually setting the limit switch bracket, horizontal alignment sensor 430, or gauge block 420 on the centering bar 410, remote input of width of vertical stack with the vertical marking system 100 may automatically adjust the horizontal alignment sensor 430 of gauge block to stop the drive chain 500 when vertical stack is in the proper position, or more sensors and programming may be added so that the length of the vertical stack is automatically sensed and the gauge block is then automatically adjusted for centering the vertical stack on the vertical marking system 100. To center the stack of pallets lengthwise for marking, the operator may adjust the limit switch bracket or gauging block 420 by sliding it on the measuring tubing 416, preferably the measuring tubing 416 is a one inch bar. As shown in FIG. 4 for one embodiment, the mid point 402 of vertical marking system 100 is depicted illustrating an approximate middle of the vertical marking system where the vertical marking system 100 may be place the mark or stamp. Another embodiment including a means for centering may include a centering bar 410 including a mid centering bracket 412. The mid centering bracket 412 may be welded to the vertical positioning mechanism 200, on the left side of the vertical positioning mechanism 200 referenced as facing the entry 320 portion of the vertical marking system 100, with the mid centering bracket 412 located in approximately the middle 402 of the vertical positioning mechanism 200. The exit centering bracket 414 may be located toward the exit end 330 of the vertical positioning mechanism 200 from the mid centering bracket 412, in alignment with the mid centering bracket 412 for receiving a measuring tube 416 and preferably welded to the vertical positioning mechanism 200. The measuring tubing 416 may be attached inside the mid 412 and exit 414 centering brackets. The measuring tubing 416 may include preferably one inch square tubing bar, with a ½ inch groove 417 with a 48 inch measuring tape 418 disposed and attached in the groove 417, bolted with the mid 412 and the exit 414 centering brackets with the measuring tape 418 glued in the groove 417. The gauging block 420 may be attached with measuring tubing 416, by loosening the end bracket 412, 414 and sliding gauging block 420 onto measuring tubing 416 then replacing the centering brackets 412, 414 to secure the gauging block 420, which can be secured in position with a bolt on the gauging block 420. Preferably the gauging block 420 has an opening of slightly over one inch to fit on one inch square tubing centering bar 410, wherein the gauging block 420 may be four inches square. The centering limit switch 430 may be attached with gauging block 420 for starting and stopping the drive chain 500 to position vertical stack for marker means to mark items in vertical stack in middle of item. The centering limit switch 430 may act as stop being operationally connected with the programmable control system 130. For example, the centering limit switch 430 may be adjusted to 48 inches for an 8 foot width/length stacks. The centering limit switch 430 may optionally be a horizontal alignment sensor 430 or a photo cell attached to the gauging block 420 operationally connected to the programmable control system 130 that triggers the vertical positioning mechanism 200 and may act as a lengthwise stop limit switch for the vertical stack.

Multiple Adjustable Vertical Positioning Mechanisms 200:

One embodiment may include a means for adjusting the distance 315 between the means for marking 250 such that the distance between the more than one means for marking 250 may be adjusted for different widths of the vertical stack of items wherein the means for adjusting the distance 315 may include the vertical marking system frame 110 with a first vertical positioning mechanism 200 and a second vertical positioning mechanism 200 attached on opposing sides with the vertical marking system frame 110 for concurrently marking on the opposing sides of the vertically stacked items as the vertical stack of items transitions from the entry 320 to the exit end 330 of the vertical marking system frame 110; and a idler sprocket 326, a drive sprocket 336, a drive chain 500, and a drive chain motor 340 attached with the vertical marking system frame 110. Another embodiment of the means for adjusting the distance 315 between the means for vertical positioning mechanisms 200 may be adjusted for different widths of vertical stacks of items may include the first and second vertical positioning mechanisms 200 with the vertical marking system frame 110 wherein the first and second vertical mechanisms 200 are on opposing sides and are moveable and may be adjusted such that a distance between the vertical positioning mechanisms 200 may be adjusted for different widths of the vertically stack of items; and the idler sprockets 326 and drive sprockets 336 and drive chain motors 340 are attached with the corresponding vertical positioning mechanisms 200. Yet another embodiment may include two vertical positioning mechanisms 200 that may be adjusted for different vertical stack width and length dimensions with an entry 320 and exit 330 opening for the vertical stacks to pass through, with an adjustable drive chain track 310 to move the vertical stack from the entry end 320 to the centered position 402, stop for marking, and when the marking is complete, moving the vertical stack to the exit end 330 to be removed from the vertical marking system 100. The means for adjusting the distance 315 between the means for marking may also include but are not limited to the following: The vertical positioning mechanisms 200 positions may be adjusted widthwise to fit the width of the stack of pallets by pressing button on the programmable control system 130 with settings for a particular dimension vertical stack. The vertical positioning mechanisms 200 may be moved by an adjustable width gear motor 301 with an adjustable horizontal worm screw 302 wherein the adjustable horizontal worm screw 302 may include half left turning threads and half right turning threads for moving the sides closer together or further apart. The two adjustable horizontal worm screws 302 attached with the vertical positioning mechanisms 200 may be attached with a horizontal worm screw track 303 and a horizontal worm screw sprockets 305 and a horizontal worm screw chain 304 such that one adjustable width gear motor 301 may drive both adjustable horizontal worm screws 302 with bearings to change the distance between the vertical positioning mechanisms 200. The adjustable width gear motor 301 may be operationally connected with the programmable control system 130 to control motion of the vertical positioning mechanisms 200. Other embodiments may include manually moving the vertical positioning mechanism or mechanisms 200, moving the vertical positioning mechanism or mechanisms 200 by a program for preset different size pallets or vertical stacks width or length, or moving the vertical positioning mechanism or mechanisms 200 automatically with the programmable control system 130 and using sensors. One end of the vertical positioning mechanisms 200 may provide an entry end 320 for the vertical stack and the other end of the vertical positioning mechanisms 200 may provide an exit end 330 for the vertical stack. The vertical positioning mechanism 200 may be constructed of steel channel and tubing.

The vertical marking system frame 110 may provide a track 322, 332 for adjustable vertical positioning mechanism 200 movement, and a mount for the vertical positioning mechanisms 200. The entry end 320 or entry portion may include an entry cross bar 322 including a tubing welded to the vertical marking system frame 110 cross ways at entrance end with angle iron shaped material welded with the ninety degree angle up to form an inverted v-shape on top of the entry cross bar for forming a v-groove caster track for the vertical positioning mechanism 200 to accommodate different widths of pallets or vertical stacks of items. Entry v-groove casters 324 may be attached with caster brackets 325 to each entry 320 vertical positioning mechanism 200 and resting on the track formed by entry cross bar angle, with preferably two v-groove casters on each entry end of each vertical positioning mechanism 200, for adjusting the vertical positioning mechanism 200 to accommodate the different side pallets or stacks of items. The exit end 330 or exit portion may include an exit cross bar 332 including a tubing welded to the vertical marking system frame cross ways at the exit end with angle iron shaped material welded with the ninety degree angle up to form a v-shape on top of the entry cross bar for forming a v-groove caster track for adjusting the vertical positioning mechanism 200 to accommodate different side pallets or stacks of items. Exit v-groove casters 334 may be attached with caster brackets 335 to each exit end 330 vertical positioning mechanism 200 and resting on the track formed by the exit cross bar angle, with preferably two v-groove casters on each exit end 330 of each vertical positioning mechanism 200, for adjusting the vertical positioning mechanism 200 to accommodate different side pallets or stacks of items.

One embodiment of the vertical marking system 100 may include the vertical positioning mechanism 200, another embodiment of the vertical marking system 100 may include the vertical positioning mechanism 200 along with the vertical marking system frame 110 wherein the vertical positioning mechanism 200 may be fixed or adjustable, and other embodiments may have additional fixed or adjustable vertical positioning mechanisms 200 depending on the desired process and automation.

Manner of Use:

With one embodiment, the forklift operator may adjust the vertical positioning mechanism 200 to fit the width of the vertical stack by pressing a button on the programmable control system 130. To center lengthwise the vertical stack for marking, the operator may adjust the limit switch bracket 420 by sliding it on the measuring tube 416 to the desired horizontal limit position for vertical stack of items alignment with the means for marking 250. The forklift operator may set a stack of pallets onto the chain drive 500 far enough in to activate the horizontal activation sensor 510. When the horizontal activation sensor 510 is activated the drive chain 500 may start to move. When the stack of pallets has traveled on the drive chain 500 to the point where centering limit switch 430 is activated, the drive chain 500 will stop. The "centering limit switch" activates the drive chain 500 to stop, it will also start the vertical threaded rod gear motor 222 which turns the vertical threaded rod 220. The vertical threaded rod 220 will start moving the vertical positioning mechanism 200 upward or downward. The printer sensor 272 located on the vertical positioning mechanism plate 212 will signal the means for marking 250 or the print head 262 to start marking or printing on each item or pallet as it moves vertically upward or downward. This process will continue until the means for marking 250 or the print head 262 reaches the a stop signal, or upper or lower limit switch 242, 243, depending on the direction of travel, located at the top or bottom of the vertical positioning mechanism 200. The upper or lower limit switch 242, 243 will signal the programmable control system 130 to stop the vertical threaded rod 220 and the marking, and signaling the programmable control system 130 to turn the drive chain 500 on and eject the vertical stack out onto a set of dead rollers through the exit end 330 of the vertical marking system 100. Once the vertical stack has cleared the vertical marking system 100, the forklift operator will load another vertical stack into the unit starting the process again. However, this time the process will be starting to print in the other direction, from the top downward or from the bottom upward. Again, the "centering limit switch" 430 stops the chains 500, and signals the programmable control system 130 to start the vertical electrical gear motor 222 in reverse turning the vertical worm screw 220 counter-clockwise. The counter-clockwise motion moves the travel mechanism plate 212 downward marking as it goes. When the vertical positioning mechanism plate 212 reaches the bottom limit switch, the marking will stop; the drive chain 500 will come on, thus ejecting the vertical stack of items. The process can be repeated over and over again as often as needed.

Figure 7:
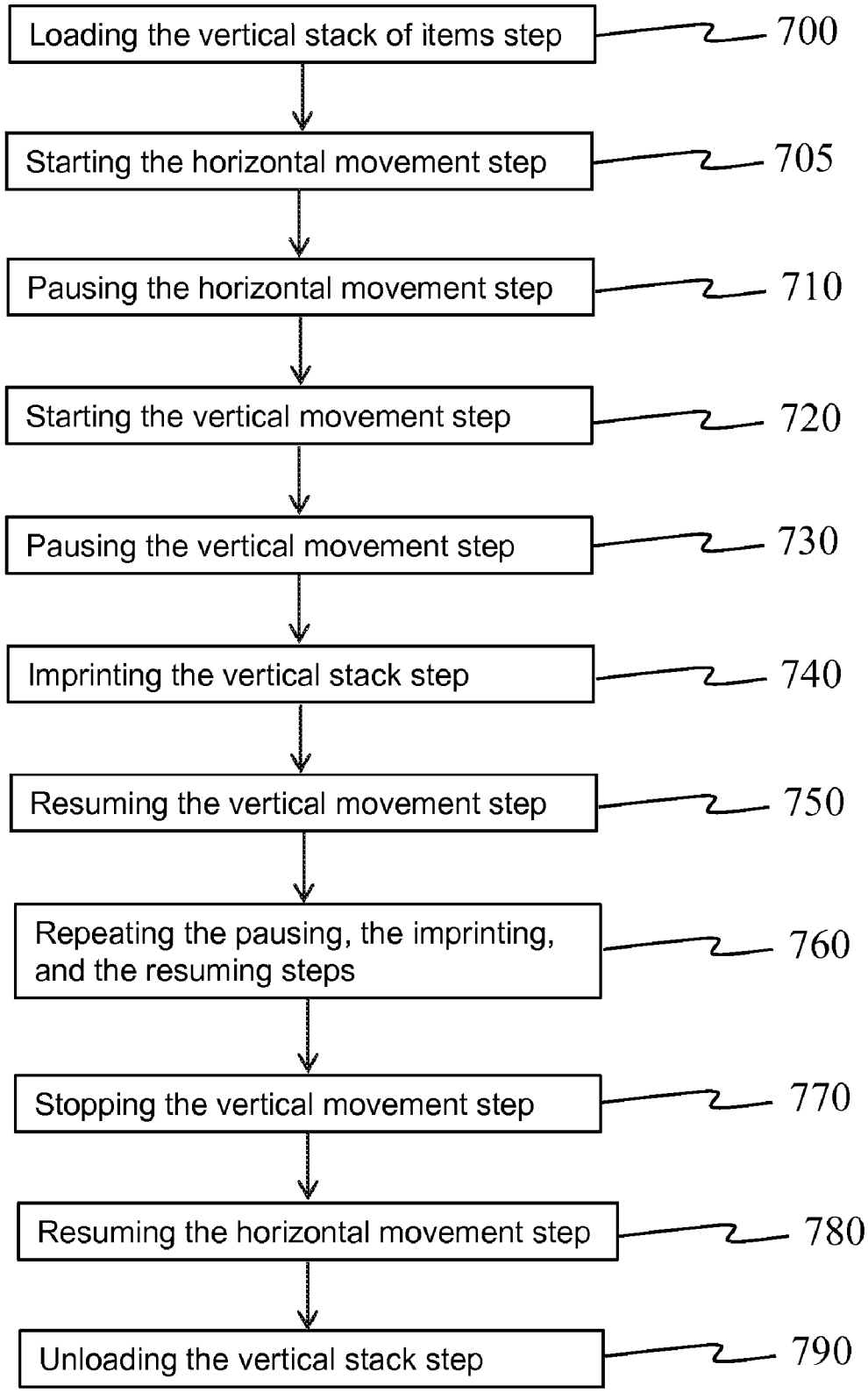
FIG. 7 is a flow chart depicting the steps in the method of an embodiment of the vertical marking system.
Figure 8:
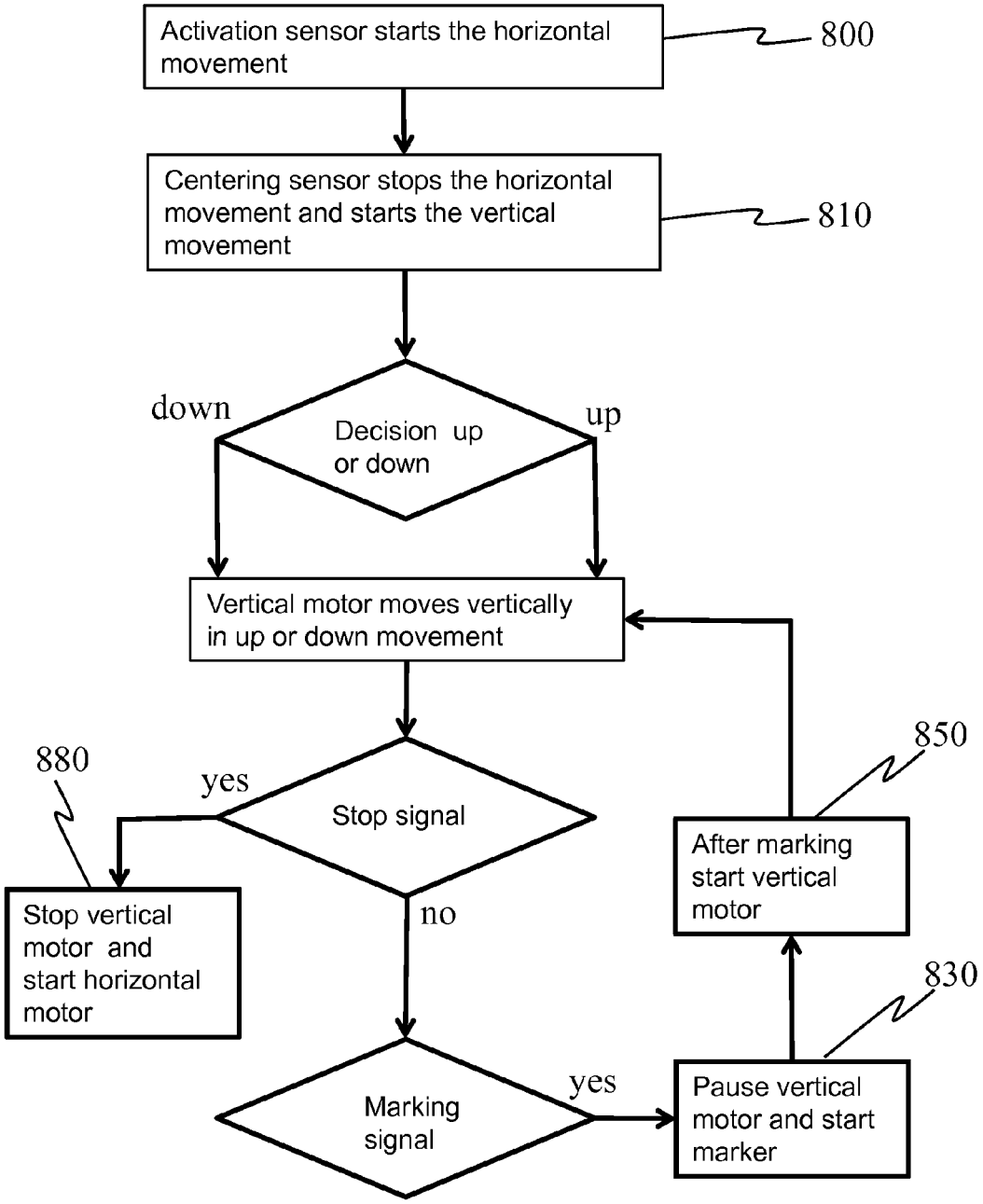
FIG. 8 is a logic chart depicting the sequence of operations of an embodiment of the vertical marking system.
Figure 9A:
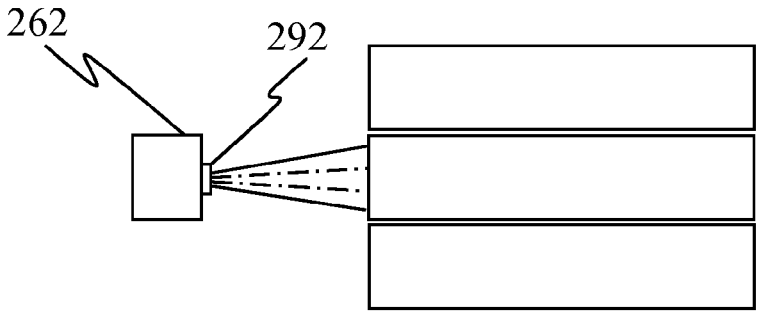
FIG. 9A is a front view of a means for marking depicting one embodiment of the vertical marking system with a laser marker with a defused lens.
Figure 9B:
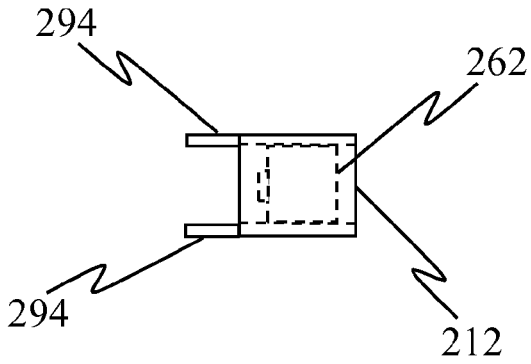
FIG. 9B is a top view of a means for marking depicting one embodiment of the vertical marking system with a means for protection.
Figure 9C:
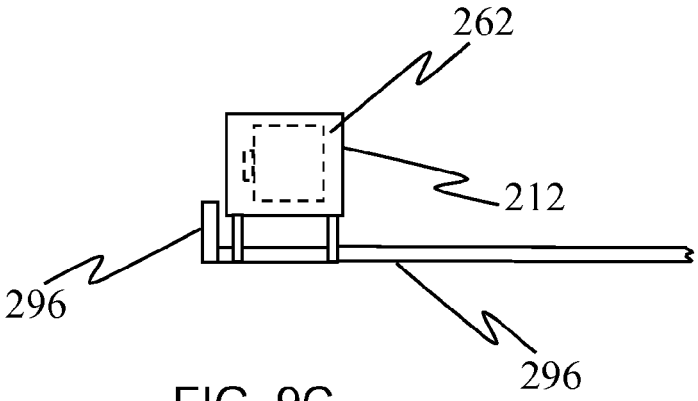
FIG. 9C is a top view of a means for marking depicting one embodiment of the vertical marking system with means for removing smoke.

Method for a Vertical Marking System:

The vertical marking system 100 also relates to a method for marking a vertical stack of items. A flow chart depicting the steps in the method of an embodiment of the vertical marking system is shown in FIG. 7. Additionally, a logic chart depicting the sequence of operations of an embodiment of the vertical marking system is shown in FIG. 8. One embodiment includes a method for marking a vertical stack of items with a means for marking and a means for vertical positioning of a vertical marking system wherein a stop signal is a limit of a vertical movement, with the method comprising the steps of: A starting the vertical movement of the means for marking step 720. An imprinting the vertical stack of items with the means for marking when the means for marking is aligned for marking in relation to the vertical stack of items step 740. And stopping the vertical movement of the means for marking when the means for vertical positioning encounters a stop signal wherein the vertical stack of items may be replaced with a next vertical stack of items step 770.

A flow chart depicting the steps in the method of another embodiment of the vertical marking system is shown in FIG. 7. This embodiment further comprises the steps of: A starting the vertical movement of the means for marking step 720. A pausing the vertical movement of the means for marking when the means for marking is aligned vertically for marking in relation to the vertical stack of items step 730. An imprinting the vertical stack of items with the means for marking when the means for marking is aligned for marking in relation to the vertical stack of items step 740. A resuming the vertical movement of the means for marking after the imprinting the vertical stack of items step 750, and repeating the pausing the vertical movement of the means for marking step 760, imprinting the vertical stack of items with the means for marking step 740, and resuming the vertical movement of the means for marking until the means for vertical positioning encounters a stop signal step 750. And stopping the vertical movement of the means for marking when the means for vertical positioning encounters a stop signal wherein the vertical stack of items may be replaced with a next vertical stack of items step 770.

A flow chart depicting the steps in the method of yet another embodiment of the vertical marking system is shown in FIG. 7. This embodiment further comprises the steps of: A loading the vertical stack of items on the vertical marking system step 700. A starting a horizontal movement of the vertical stack of items transitioning through the vertical marking system step 705 is depicted as represented by 800 in FIG. 8. A pausing the horizontal movement of the vertical marking system when the means for marking is aligned horizontally for marking in relation to the vertical stack of items step 710 is depicted as represented by 810 in FIG. 8. A starting the vertical movement of the means for marking step 720 is depicted as represented by 810 in FIG. 8. A pausing the vertical movement of the means for marking when the means for marking is aligned vertically for marking in relation to the vertical stack of items step 730 is depicted as represented by 830 in FIG. 8. An imprinting the vertical stack of items with the means for marking when the means for marking is aligned for marking in relation to the vertical stack of items step 740. A resuming the vertical movement of the means for marking after the imprinting the vertical stack of items step 750 is depicted as represented by 850 in FIG. 8, and repeating the pausing the vertical movement of the means for marking step 760, wherein the repeating the pausing the vertical movement of the means for marking step 760 also comprises the steps of: imprinting the vertical stack of items with the means for marking step 740, and resuming the vertical movement of the means for marking until the means for vertical positioning encounters a stop signal step 750. And stopping the vertical movement of the means for marking when the means for vertical positioning encounters a stop signal, wherein the vertical stack of items may be replaced with a next vertical stack of items step repeating the pausing the vertical movement of the means for marking step 770 is depicted as represented by 880 in FIG. 8. A resuming the horizontal movement of the vertical marking system step repeating the pausing the vertical movement of the means for marking step 780 is depicted as represented by 880 in FIG. 8. And an unloading the vertical stack of items from the vertical marking system step repeating the pausing the vertical movement of the means for marking step 790.

What is claimed is:

1. A vertical marking system for marking a vertical stack of items comprising:

a vertical positioning mechanism;

a laser marker attached with the vertical positioning mechanism for marking an item in the vertical stack of items;

a vertical sensor attached with the vertical positioning mechanism for sensing the items that are in the vertical stack of items and for sensing an upper limit of travel and a lower limit of travel for the vertical positioning mechanism; and a programmable control system for controlling the vertical marking system whereby the programmable control system is operationally connected with the vertical positioning mechanism, the laser marker, and the vertical sensor such that time laser marker continues moving vertically until reaching a marking signal, whereby the marking signal is computed by the programmable control system operationally connected with the vertical sensor and is aligned to pause a vertical movement such that the laser marker is vertically aligned in relation to the item of the vertical stack of items for marking, marks the item, and thereafter the vertical positioning mechanism moves the laser marker vertically and continues moving vertically and marking items until reaching a stop signal, whereby the stop signal is computed by the programmable control system operationally connected with the vertical sensor and is the upper limit of travel or the lower limit of travel, wherein the vertical movement stops for replacing the vertical stack of items with a next vertical stack of items;

wherein the vertical positioning mechanism further comprises:

a vertical positioning frame, an upper support structure, a vertical positioning mechanism plate for attaching the laser marker with the vertical positioning mechanism, a vertical threaded rod including upper and lower vertical threaded rod bearings for attaching the vertical threaded rod with the vertical positioning frame and the upper support structure, a vertical threaded rod gear motor attached with the vertical threaded rod and the vertical positioning frame, and vertical support tubing attached with the vertical positioning frame, the vertical positioning mechanism plate, and the upper support structure such that the vertical positioning mechanism plate is attached with the vertical threaded rod and the vertical position mechanism plate travels vertically up and down the vertical threaded rod as the vertical threaded rod is rotated by the vertical threaded rod gear motor whereby the programmable control system is operationally connected with the vertical threaded rod gear motor and the vertical sensor for vertically raising and lowering the laser marker.

2. The vertical marking system as set forth in claim 1 wherein:

the laser marker further comprises a defused lens such that the defused lens produces a broader mark on the item;

the vertical marking system further comprises a means for removing smoke created from the laser marker burning the mark on the item wherein the vertical stack of items is a vertical stack of wooden pallets; and the vertical marking system further comprises a wireless communication system operationally connected with the laser marker such that a design for the mark may be remotely changed.

3. A method for marking a vertical stack of items with the device as set forth in claim 1, the method comprising steps of:

starting the vertical movement of the laser marker;

imprinting the vertical stack of items with the laser marker when the laser marker is aligned for marking in relation to the vertical stack of items; and stopping the vertical movement of the laser marker when the vertical positioning mechanism encounters the stop signal wherein the vertical stack of items may be replaced with the next vertical stack of items.

4. The method for marking the vertical stack of items according to claim 3, further comprising the steps of:

pausing the vertical movement of the laser marker when the laser marker is aligned vertically for marking in relation to the vertical stack of items, after the starting the vertical movement of the laser marker step and before the imprinting the vertical stack of items step;

resuming the vertical movement of the laser marker after the imprinting the vertical stack of items step; and repeating the pausing the vertical movement of the laser marker step, imprinting the vertical stack of items with the laser marker step, and resuming the vertical movement of the laser marker step until the vertical positioning mechanism encounters the stop signal, wherein the resuming the vertical movement of the laser marker step and the repeating the pausing the vertical movement of the laser marker step are inserted after imprinting the vertical stack of items step and before the stopping the vertical movement of the laser marker step.

5. A vertical marking system for marking a vertical stack of items comprising:

a vertical positioning mechanism;

a laser marker attached with the vertical position mechanism for marking an item in the vertical stack of items;

a vertical sensor attached with the vertical positioning mechanism for sensing the items that are in the vertical stack of items and for sensing an upper limit of travel and a lower limit of travel for the vertical positioning mechanism; and a programmable control system for controlling the vertical marking system whereby the programmable control system is operationally connected with the vertical positioning mechanism, the laser marker, and the vertical sensor such that the laser marker continues moving vertically until reaching a marking signal, whereby the marking signal is computed by the programmable control system operationally connected with the vertical sensor and is aligned to pause the vertical movement such that the laser marker is vertically aligned in relation to the item of the vertical stack of items for marking, marks the item, and thereafter the vertical positioning mechanism moves the laser marker vertically and continues moving vertically and marking items until reaching a stop signal, whereby the stop signal is computed by the programmable control system operationally connected with the vertical sensor and is the upper limit of travel or the lower limit of travel, wherein the vertical movement stops for replacing the vertical stack of items with a next vertical stack of items; a vertical marking system frame attached with the vertical positioning mechanism, wherein the vertical marking system frame includes a base, an entry end of the base and an exit end of the base, an idler sprocket attached with the vertical marking system, a drive sprocket attached with the vertical marking system, a drive chain attached with the idler sprocket and the drive sprocket, and a drive chain motor attached with the drive sprocket such that the drive chain horizontally moves the vertical stack of items from the entry end to the exit end;

a horizontal activation sensor operationally connected with the programmable control system such that the horizontal activation sensor senses the vertical stack of items at the entry end of the frame and the programmable control system activates the drive chain; and a horizontal alignment sensor operationally connected with the programmable control system whereby the horizontal alignment sensor stops the drive chain when the vertical stack of items is in alignment for marking with the laser marker.

6. The vertical marking system as set forth in claim 5 further comprising:

a second vertical positioning mechanism attached with the vertical marking system frame and a second laser marker attached with the second vertical positioning mechanism, for concurrently marking, on opposing sides, the item of vertical stack of items.

7. The vertical marking system as set forth in claim 6 wherein the first and second vertical positioning mechanisms are attached with the vertical marking system such that the first and second vertical positioning mechanisms may be adjusted in relationship such that a distance between the first and second vertical position mechanisms may be adjusted for a width of the vertical stack of items.

8. The vertical marking system as set forth in claim 7 wherein:

the vertical marking system frame further comprises:

a second idler sprocket, a second drive sprocket, a second drive chain, and a second drive chain motor attached with the second drive sprocket wherein the second drive chain is attached with the second idler sprocket and the second drive sprocket, wherein the first idler sprocket and the first drive sprocket are attached with the first vertical positioning mechanism, and wherein the second idler sprocket and the second drive sprocket are attached with the second vertical positioning mechanism such that the first and second drive chain horizontally moves the vertical stack of items from the entry end the exit end; and a forward/reverse electrical switch attached with the first and second drive chain gear motor for adjusting the vertical stack of items as it transitions through the vertical marking system wherein the forward/reverse switch is operationally connected with the programmable control; and the first and second vertical positioning mechanisms further comprise:

v-groove casters attached with the entry end and the exit end of the first vertical positioning mechanism, v-groove casters attached with the entry end and the exit end of the second vertical positioning mechanism, v-groove caster tracks at the entry end of the base and at the exit end of the base for the v-groove casters of the first and second vertical positioning mechanism to engage and to aid in adjusting the first vertical positioning mechanism in relationship to the second vertical positioning mechanism, and an adjustable width gear motor, and a horizontal worm screw, wherein the adjustable width gear motor is operationally connected with the programmable control system and the adjustable width gear motor is attached with the horizontal worm screw and attached with the first and second vertical positioning mechanisms for adjusting the vertical positioning mechanisms for the width of the vertical stack of items.

9. The vertical marking system as set forth in claim 5 wherein:

the laser marker further comprises a defused lens such that the defused lens produces a broader mark on the item;

the vertical marking system further comprises a means for removing smoke created front the laser marker burning the mark on the item wherein the vertical stack of items is a vertical stack of wooden pallets; and the vertical marking system further comprises a wireless communication system operationally connected with the laser marker such that a design for the mark may be remotely changed.

10. A method for marking a vertical stack of items with the device as set forth in claim 5 comprising the steps of:

loading the vertical stack of items on the vertical marking system;

starting a horizontal movement of the vertical stack of items transitioning through the vertical marking system;

pausing the horizontal movement of the vertical marking system when the means for marking is aligned horizontally for marking in relation to the vertical stack of items;

starting the vertical movement of the laser marker;

imprinting the vertical stack of items with the laser marker when the laser marker is aligned for marking in relation to the vertical stack of items until the vertical positioning mechanism encounters the stop signal;

stopping the vertical movement of the laser marker when the vertical positioning mechanism encounters the stop signal;

resuming the horizontal movement of the vertical marking system; and unloading the vertical stack of items from the vertical marking system.

* * * * *